US005452872A

United States Patent [19]

Barnes et al.

[11] Patent Number: 5,452,872

[45] Date of Patent: Sep. 26, 1995

[54] STABILIZER SYSTEM FOR PORTABLE IRRIGATION LINE

[76] Inventors: Hersel E. Barnes, 175 S. 600 E.; Mitchell D. Barnes, 401 W. 100 S., both of Jerome, Id. 83338

[21] Appl. No.: 200,774

[22] Filed: Feb. 22, 1994

[51] Int. Cl.[6] ..... B05B 15/06

[52] U.S. Cl. ..... 248/85; 248/81; 248/168

[58] Field of Search ..... 248/49, 83, 85, 248/87, 163.1, 81, 121, 168, 440.1, 528, 519, 177; 354/293; D16/244

[56] References Cited

U.S. PATENT DOCUMENTS

| | | | |
|---|---|---|---|
| 807,184 | 12/1905 | Malnburg | 248/83 |
| 1,058,090 | 4/1913 | Nelson . | |
| 1,128,248 | 2/1915 | Hetzel | 248/85 |
| 1,192,313 | 7/1916 | Howell | 248/81 |
| 1,873,672 | 8/1932 | Theys . | |
| 1,959,886 | 5/1934 | Wadsworth | 248/168 |
| 2,192,649 | 3/1940 | Parker | 248/83 |
| 2,219,400 | 10/1940 | Ritzinger et al. | 248/83 |
| 2,242,840 | 5/1941 | Warden, Sr. | 248/83 |
| 2,622,829 | 12/1952 | Waltz | 248/42 |
| 2,694,600 | 11/1954 | Richey | 299/47 |
| 2,736,525 | 2/1956 | Jones | 248/83 |
| 2,792,257 | 5/1957 | Davis | 248/83 |
| 2,795,459 | 6/1957 | Cornelius | 248/168 |
| 2,939,666 | 6/1960 | Ohre | 248/76 |
| 2,940,708 | 6/1960 | Grimal | 248/177 |
| 3,717,320 | 2/1973 | Hill | 248/83 |
| 4,521,036 | 6/1985 | Howell, Jr. et al. | 285/61 |
| 4,824,020 | 4/1989 | Harward | 239/264 |
| 5,337,960 | 8/1994 | Allen | 239/280.5 |

*Primary Examiner*—Leslie A. Braun
*Assistant Examiner*—Anita M. King
*Attorney, Agent, or Firm*—Barbara S. Pedersen; Ken J. Pedersen

[57] ABSTRACT

Various embodiments of a stabilizer system for portable irrigation equipment are shown and described. Each embodiment includes a stabilizer which attaches to a vertical riser and has two legs that pivot independently to opposite sides of the main pipe of the irrigation line to be firmly planted on the ground for holding the riser upright to achieve optimum irrigation sprinkling. Preferably, the stabilizer attaches to the riser by means of a horizontal spring clip that frictionally engages the riser. Preferably, the two legs pivot about 180 degrees for making easier the installation and storage of the stabilizer and for making easier the moving of the irrigation lines. Optionally, the stabilizer system may include a retainer for holding the legs in a collapsed position close to the riser to make easier the moving and storing of the irrigation lines with the stabilizer remaining attached.

15 Claims, 9 Drawing Sheets

STABILIZER SYSTEM FOR PORTABLE IRRIGATION LINE

BACKGROUND OF THE INVENTION

1. Field of the Invention

This invention relates generally to supports or stabilizers for irrigation equipment. More specifically, this invention relates to stabilizers for holding the risers and sprinkler heads of portable irrigation pipes in an upright position.

2. Related Art

In many agricultural and horticultural settings, rigid, above-ground, portable sprinkler systems are used for irrigation of crops, pasture, trees, or grasses, etc. These systems are typically constructed of long segments of main pipe, with one or more risers upending at a 90 degree angle from each segment of main pipe and a sprinkler head connected to the distal end of each riser. The segments are laid out and connected to each other in series, creating an irrigation line that extends all or most of the way across a field. In some portable systems, which are often called "hand-line" systems, one or more of these irrigation lines are periodically moved by hand an incremental distance across the field to irrigate an incremental portion of the field. In other portable systems, which are often called "solid-set" systems, a plurality of irrigation lines are set up in parallel across the entire field and left in place for the entire growing season. The "solid-set" system allows irrigation of the entire field without the labor and inconvenience of moving the irrigation line segments and prevents the damage to crops that may be caused by moving irrigation equipment. When the irrigation season is over, the segments of both the hand-line and solid-set systems are usually disconnected and stacked at one side of the field or otherwise stored, so that the crops may be harvested and the ground may be worked in preparation for the next growing season.

A common problem of these portable irrigation lines is the difficulty of keeping the risers in an upright, vertical position for efficient, thorough, and even sprinkling. Unconnected individual segments of the lines tend to fall over to place the risers against the ground or crops, or, once the segments are connected together, the irrigation line is often so long that a part or an end of the line will lean or fall. The problem is somewhat alleviated by the straightening tendency of the force of water being pumped through the line, but the problem may reoccur when the water is shut off and each time the line is moved or adjusted.

To try to solve this problem, irrigators sometimes wire or tie two pieces of wood lath onto the risers in an X-shape, with a foot of the X resting on the ground on each side of the main pipe. These wooden X's improve the stability of the segments and the irrigation lines, but are time-consuming and difficult to install and prone to breaking and slipping.

When the irrigation lines are stored for the winter, the wooden X's are typically removed from the risers and placed in a pile to prevent the X's from being torn apart, breaking, tangling, or interfering with the neat stacking and storage of the irrigation line segments.

A patent issued to F. F. Ohre (U.S. Pat. No. 2,939,666) discloses a stabilizer for portable irrigation equipment. The Ohre device is an A-shaped rigid frame with rigid arms for receiving the riser when the frame is leaned against the riser. The Ohre stabilizer remains in place by virtue of its leaning position, heaviness, and off-center center-of-gravity.

Other U.S. Patents disclose devices for supporting flexible hoses, including Theys (U.S. Pat. No. 1,873,672), Parker (U.S. Pat. No. 2,192,649), and Jones (U.S. Pat. No. 2,736,525). Theys discloses a sprinkler support including an inverted-U-shaped stand, a U-shaped saddle extending from and generally co-planar with the stand for receiving a hose, and two prop-forming bars attached to the inverted-U-shaped stand. Parker discloses a hose holder with two pivotally-connected legs. The upper end of one or both of the legs form a hook, which is co-planar with the legs and is adapted to receive a hose that runs perpendicular to the legs. Jones discloses a bipod hose support having two vertical legs attached to an open-ended horizontal sleeve that receives a horizontal hose. Clamping nuts and bolts secure the legs of the Jones device in their radially adjusted positions.

Hill (U.S. Pat. No. 3,717,320) and Harward (U.S. Pat. No. 4,824,020) disclose stands for holding sprinkler heads in an upright position. The Hill stand, which is for cold deck log storage, has two pivotal legs, which penetrate into a log, and a center main upright. The center main upright has a compression spring, which pushes against the log to put the two pivotal legs under tension. The two pivotal legs are fastened to a tubular bracket which surrounds the center main upright. The Harward stand includes a central support hub and at least five flexible elongate legs attached to the support hub for extending down and outward from the hub.

What is still needed is a portable irrigation equipment stabilizer that is simple, compact, light-weight, inexpensive, and effective. A stabilizer system is needed that is easily used, repaired, transported, and stored.

DISCLOSURE OF THE INVENTION

The main object of the invented stabilizer system is to effectively and efficiently stabilize a portable irrigation line that includes a horizontal main pipe and vertical risers upending from the main pipe. Other objects of the present invention include simplicity, economy, and ease of use, repair, and storage.

The invented stabilizer system comprises a stabilizer including an attachment means adapted to receive and frictionally engage a vertical riser and two legs connected by a connection means to the attachment means so that each leg may pivot, independently from the other leg, in a vertical plane. The stabilizer system may further comprise a leg-retention means for securing the legs for storage in a collapsed position close to the riser and main pipe.

The stabilizer attachment means may be a spring clip that includes two horizontal resilient arms for receiving the vertical riser. The spring clip attaches to the riser securely but also in a manner that allows the stabilizer to be removed from the riser without tools or great effort.

The two legs pivot independently to contact the ground on opposite sides of the main pipe, thereby stabilizing the irrigation line or segment from leaning or falling over to either side, even when the line or segment lies on sloped, uneven, mounded, or rocky ground. Preferably, the legs may each pivot about 180 degrees, but, alternatively, the two legs may each pivot from about 45 degrees to about 360 degrees. The two legs may be pivotally connected to each other at a point of pivot to form a leg unit and the leg unit may be connected, pivotally or otherwise, to the attachment means. Alternatively, the two legs may be pivotally connected to the attachment means by the connection means without being directly connected to each other.

The optional leg-retention means of the stabilizer system is for securing the two legs of the stabilizer in a collapsed position to keep the legs out of the way during storing or stacking of the irrigation line or irrigation line segments. The leg-retention means may be a retainer, comprising a retainer attachment means for attachment to the lower part of the riser and leg clips connected to the attachment means for removably snapping around each of the legs.

The preferred stabilizer system may be securely installed for long-term use through a growing season, or may be removed without difficulty at any time. While the irrigation line or segment is being moved or stored, the stabilizer may be left to hang on the riser, preferably, but not necessarily, with the two legs collapsed and held by the leg retention means, and, thus, without impeding movement or storage and without entangling in the crops. Alternatively, the preferred stabilizer may be quickly pulled off the riser with one firm tug and may later be reinstalled with a quick snap of the spring clip onto the riser.

The stabilizer system pivotal legs, leg-retention means, and light-weight design make a more effective, more convenient, and less crop-damaging system than rigid, heavy, or bulky designs. The simple and modular design of the stabilizer system allows easy and inexpensive repair or replacement.

DETAILED DESCRIPTION OF THE PREFERRED EMBODIMENT

Figure 1:
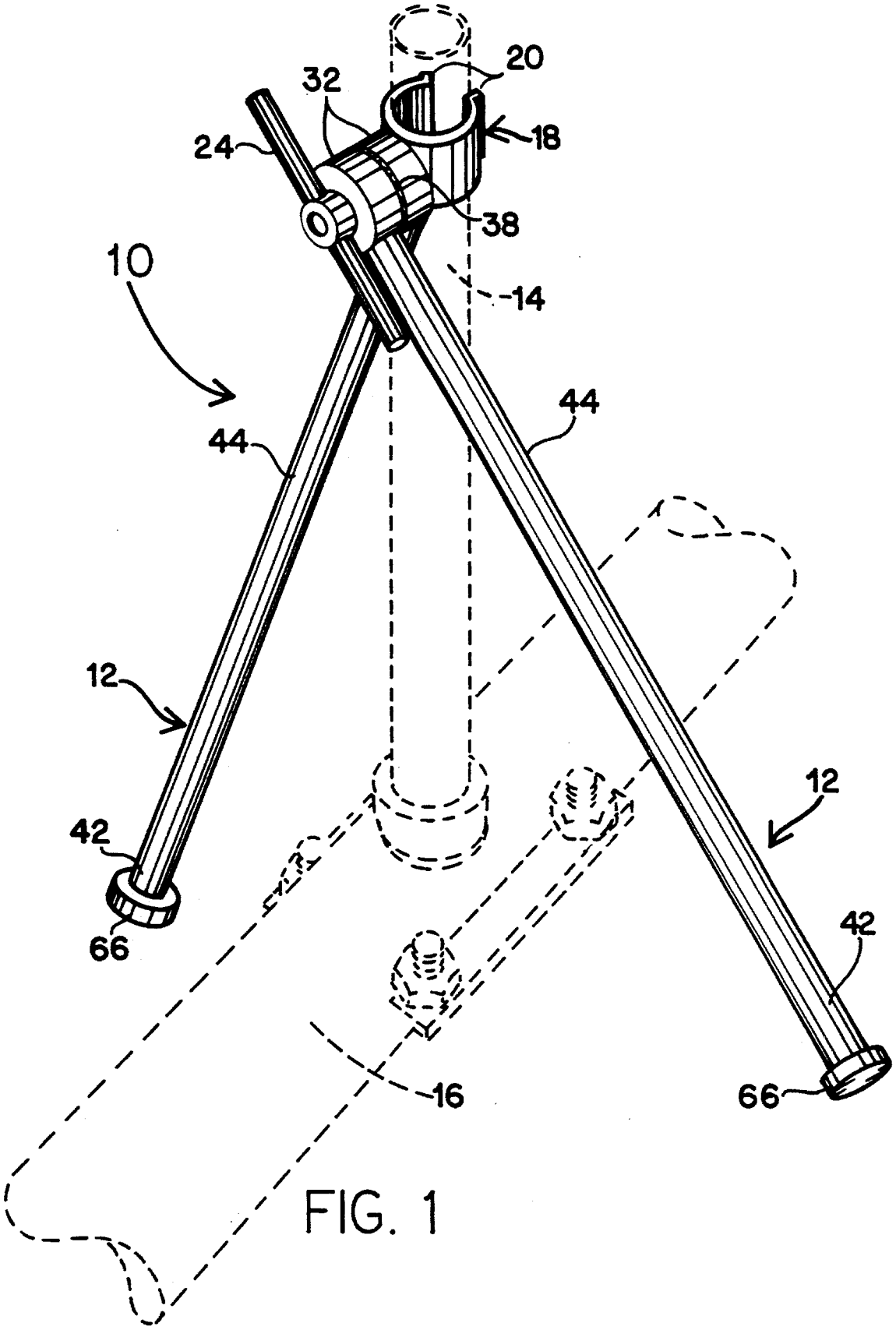
FIG. 1 is a perspective view of one embodiment of the invention installed on an irrigation line riser.

Referring to FIGS. 1–9, there are shown several, but not the only, embodiments of the invented stabilizer system for portable irrigation equipment. The stabilizer system may comprise a stabilizer and an optional leg-retention means. The stabilizer 10 comprises an attachment means, a leg unit comprising two legs 12, and a connection means for connecting the leg unit to the attachment means. The stabilizer attachment means is adapted to receive and frictionally engage a vertical riser 14. The two legs 12 are connected to the attachment means in such a manner that they pivot in a vertical plane or planes to extend to touch the ground on opposite sides of the main pipe 16 of the irrigation line. Thus, the two legs 12 act as side supports that prevent the irrigation line segment or entire irrigation line from leaning or falling over to either side.

The stabilizer attachment means may be a spring clip 18 which may be snapped on to and off of the vertical riser 14. The spring clip 18 includes two horizontal resilient arms 20 for snapping around the vertical riser 14 and for frictionally engaging the riser 14, thus, securing the stabilizer 10 onto the riser 14 and also preventing the stabilizer 10 from slipping longitudinally up or down the riser 14 unless purposely-moved by the irrigator. The spring clip 18 is typically sized to fit about a one-and-¼ inch outer-diameter riser 14, but may be sized to fit any diameter of riser 14.

Figure 2:
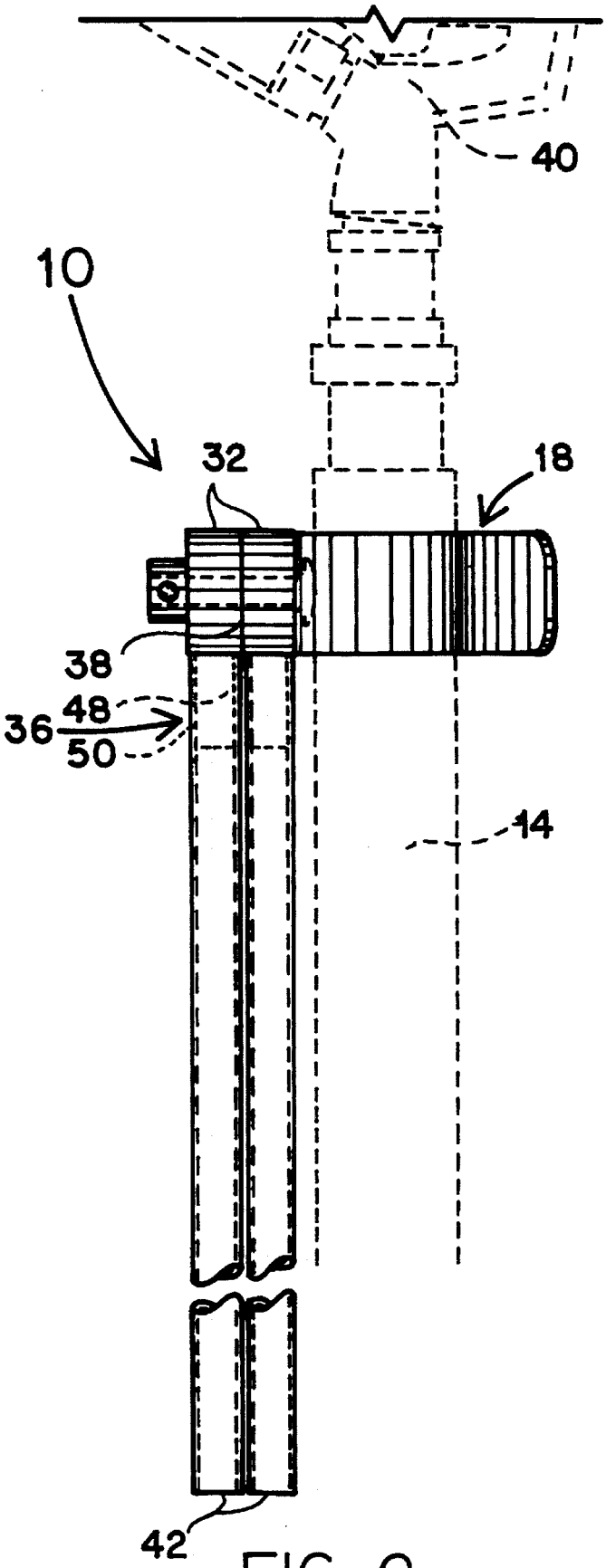
FIG. 2 is a right side view of the embodiment of FIG. 1, shown without optional caps on the foot ends.
Figure 4:
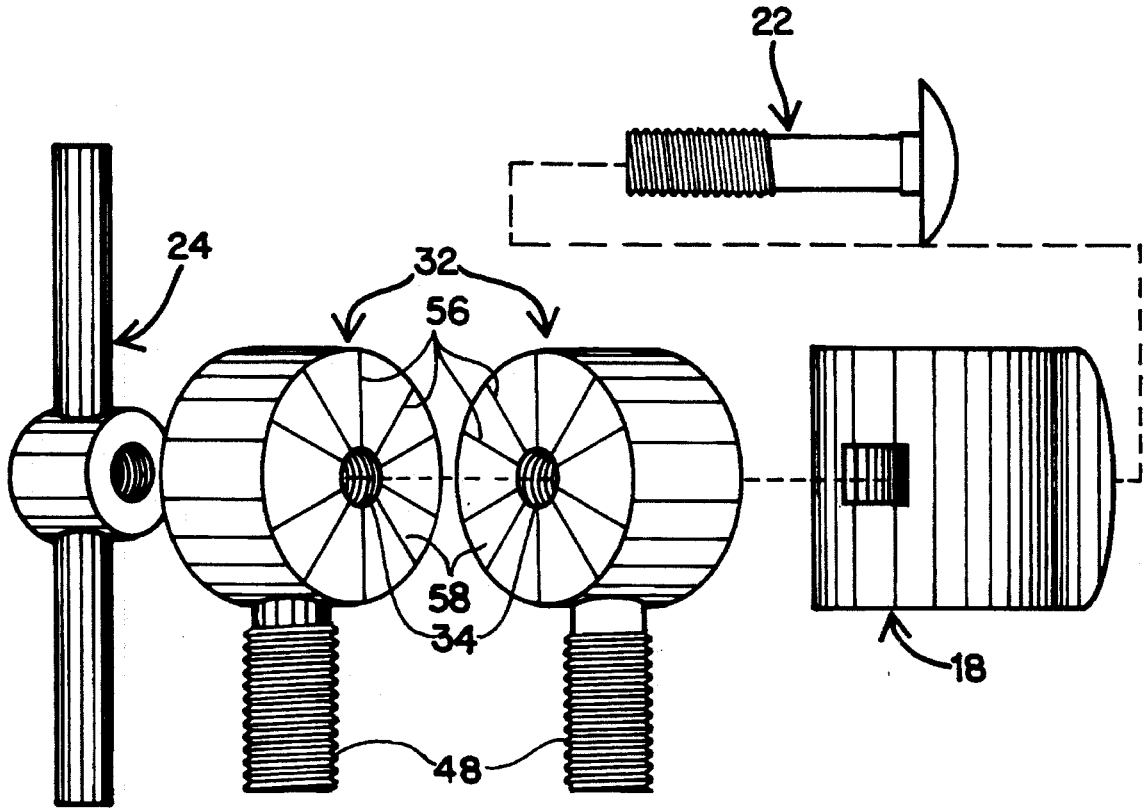
FIG. 4 shows details of how some of the elements of the embodiment of FIG. 1 connect together.
Figure 5:
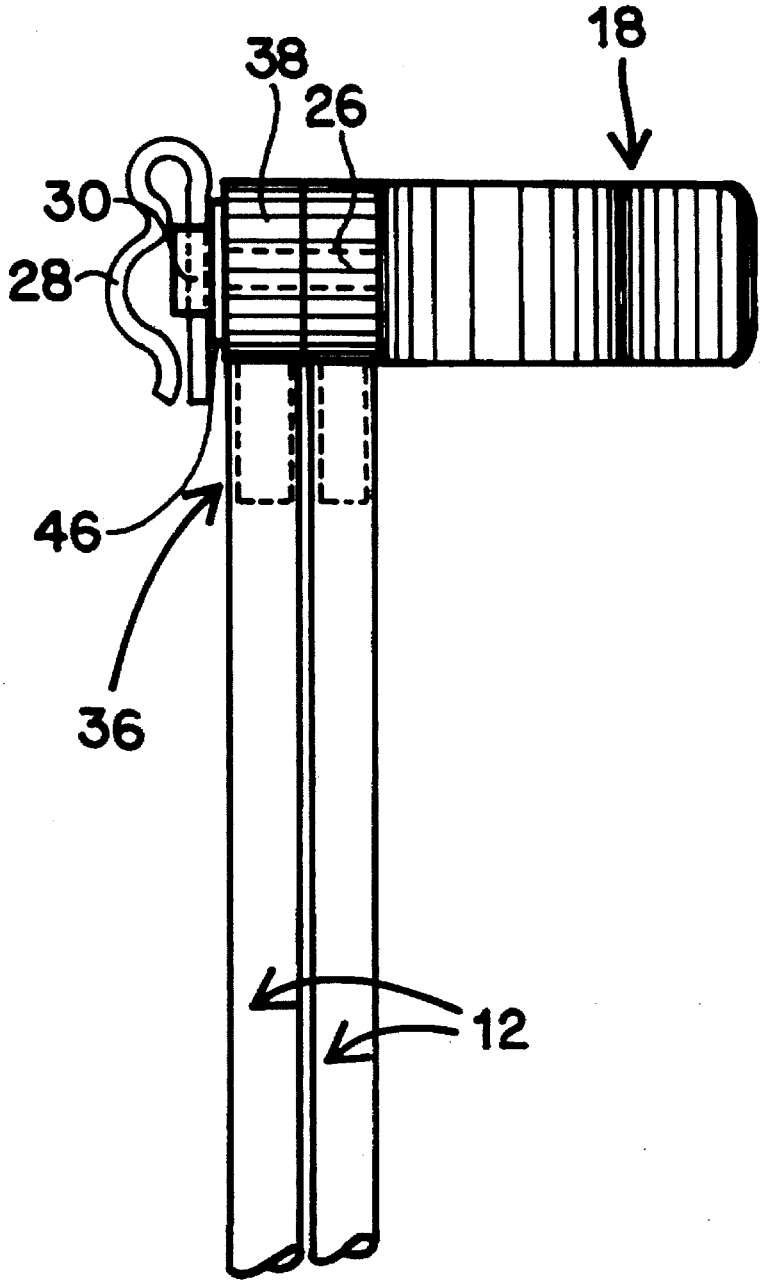
FIG. 5 is a right side view of another embodiment of the invention, featuring a smooth rod and a "bobby-pin" style pin as a connection means.
Figure 6:
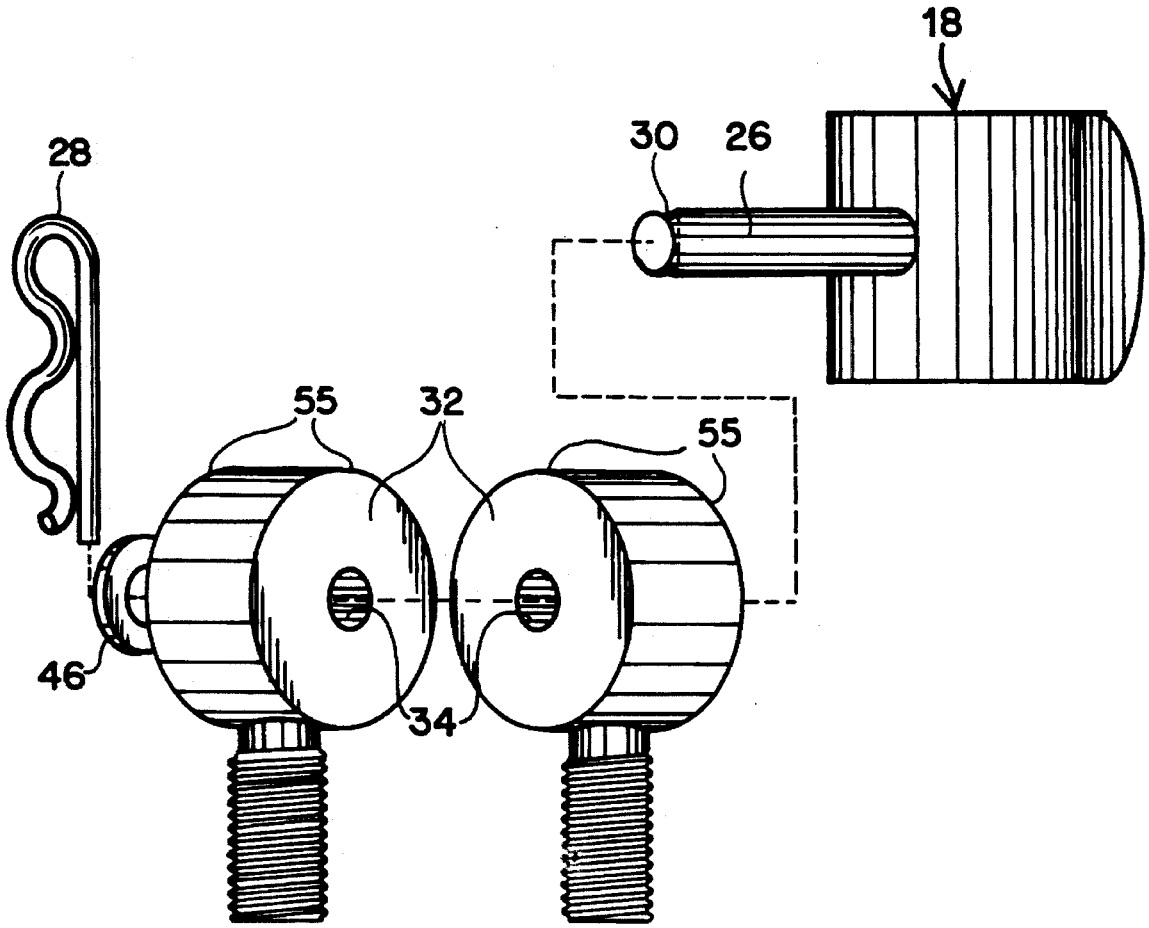
FIG. 6 shows details of how some of the elements of the embodiment of FIG. 5 connect together.

The stabilizer connection means is preferably a horizontal member that comprises a horizontal shaft and a lock means. In FIG. 4, the horizontal shaft is a threaded bolt 22 connected to and extending horizontally from the spring clip 18, and the lock means is a threaded winged nut 24 for being turned onto the bolt 22. In FIG. 5, the horizontal shaft is a generally smooth rod 26 and the lock means is a removable "bobby-pin" style pin 28 extending through a bore 30 in the distal end of the rod 26. In the embodiments in FIGS. 4 and 5, the top end 32, of each leg 12 has a horizontal bore 34, through which the horizontal shaft is pivotally received. In these embodiments, therefore, the two legs 12 are pivotally connected to each other at their top ends 32, to form a leg unit 36 with a point of pivot 38 at the leg top ends 32, as illustrated in FIGS. 2 and 5. In alternative embodiments, the stabilizer legs may be connected to each other at other than their top ends to form a leg unit with a point of pivot at other than the leg top ends.

Optionally, the stabilizer connection means may connect the leg unit to the attachment means in a pivotal manner to give additional flexibility in installing the stabilizer in cases of uneven ground or cramped conditions. For example, as shown in FIG. 4, the bolt 22 may extend through, but not be welded to, the spring clip 18, thus allowing the spring clip 18 to pivot around the longitudinal axis of the bolt 22.

In other embodiments, the legs are connected to the attachment means without being connected directly to each other. For example, one leg may be pivotally fastened to each of the resilient arms of a spring clip attachment means.

Figure 3:
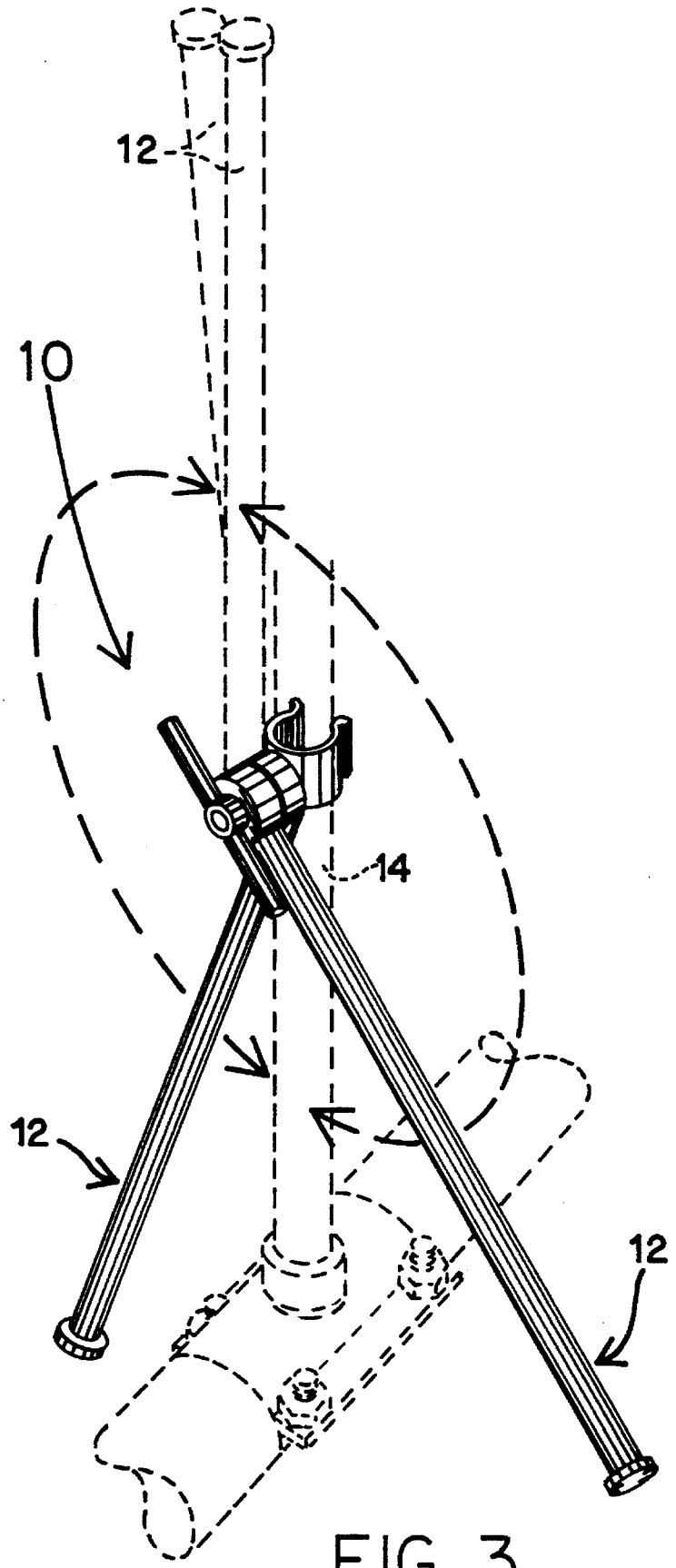
FIG. 3 is a perspective view of the embodiment of FIG. 1, showing how the legs may pivot to extend vertically upward and vertically downward.

As shown in FIGS. 1–6, the legs 12 of the stabilizer 10 extend about perpendicularly to the horizontal shaft and pivot around the horizontal shaft in vertical, parallel planes. The two legs 12 in the embodiments of FIGS. 1–6 pivot 360 degrees, each in its own vertical plane, but, alternatively, the legs may be designed to pivot a lesser amount or to pivot in the same vertical plane. Preferably, the legs should each pivot more than 45 degrees from the downward, collapsed position to allow convenient installation and effective stabilizing. Preferably, the legs should pivot at least 180 degrees so that each leg may be swung vertically upwards to be generally parallel to the riser 14 and near the sprinkler head 40 or vertically downwards to be generally parallel to the riser 14 and near to the main pipe 16, as shown in FIG. 3. This 180 degree minimum pivoting and the optional pivoting of the spring clip 18 around the horizontal shaft allow the user to move the legs 12 to a variety of positions relative to each other, the spring clip 18, and the riser 14, thus making easier the carrying, installing, adjusting, moving, and storage of the stabilizer 10 and also of the irrigation lines when the stabilizer 10 is attached.

To install the stabilizer 10, the spring clip 18 is snapped onto the riser 14 and the legs 12 are pivoted to contact the ground on opposite sides of the main pipe 16, preferably, but not necessarily, at about a 45 to 60 degree angle with the ground. The spring clip 18 may be snapped onto the riser at various heights above the main pipe, but should be snapped on at a height that allows the leg foot ends 42 to be planted firmly on the ground. The two legs 12 pivot independently, so that the leg foot ends 42 may be planted firmly on uneven or sloped ground.

Figure 9:
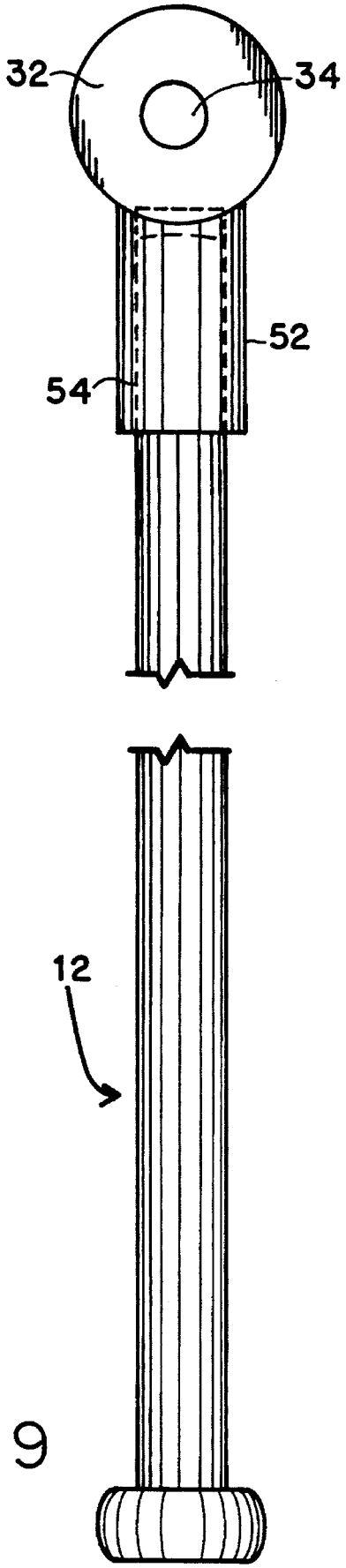
FIG. 9 is a front view of an alternative embodiment of a stabilizer leg.

In embodiments such as shown in FIGS. 1–6, where the point of pivot 38 is located at the leg top ends 32, the top end 32 of each leg 12 preferably is wider than the widths of its respective center portion 44 and foot end 42, thus allowing the legs 12 to pivot together or past each other without hitting and binding. Also, the legs 12 and the horizontal member are preferably sized to keep the connection between the leg top ends 32, and the spring clip 18 tight enough to prevent the legs 12 from wobbling forward or backward. Optionally, a washer 46 may be added to tighten the connection. Preferably, the top end 32, and center portion 44 of the legs 12 are threaded or otherwise disconnectable to cooperate so that they may be easily disconnected for repair or replacement. The top end 32 may have a top end male fitting 48 cooperating with a center portion female fitting 50, as shown in FIGS. 2 and 4, or a top end female fitting 52 cooperating with a center portion male fitting 54, as shown in FIG. 9. Optionally, the edges 55, of the top ends 32, may be rounded or otherwise smoothed to prevent the edges 55 from cutting an irrigator's hands.

Optionally, a clamping means may be provided to clamp the two legs 12 into a desired position. For example, the bolt 22 and nut 24 of the embodiment in FIG. 1 may be threaded so that the nut 24 may be turned-in to the point where significant pressure is placed on the top ends 32 of the legs 12, thus pressing the legs 12 against the spring clip 18 and tending to clamp the legs 12 and keep them from pivoting out of the chosen position. Optionally, there also may be grips 56 cut in the faces 58 of the leg top ends 32, as shown in FIG. 4, so that, when the nut 24 and bolt 22 are tightened, increased friction between the faces 58 tends to clamp the legs 12 in position. Preferably, when the clamping means is released or in the absence of a clamping means, the legs 12 automatically and easily pivot down to a collapsed position when the irrigation line or segment is picked up.

Figure 7:
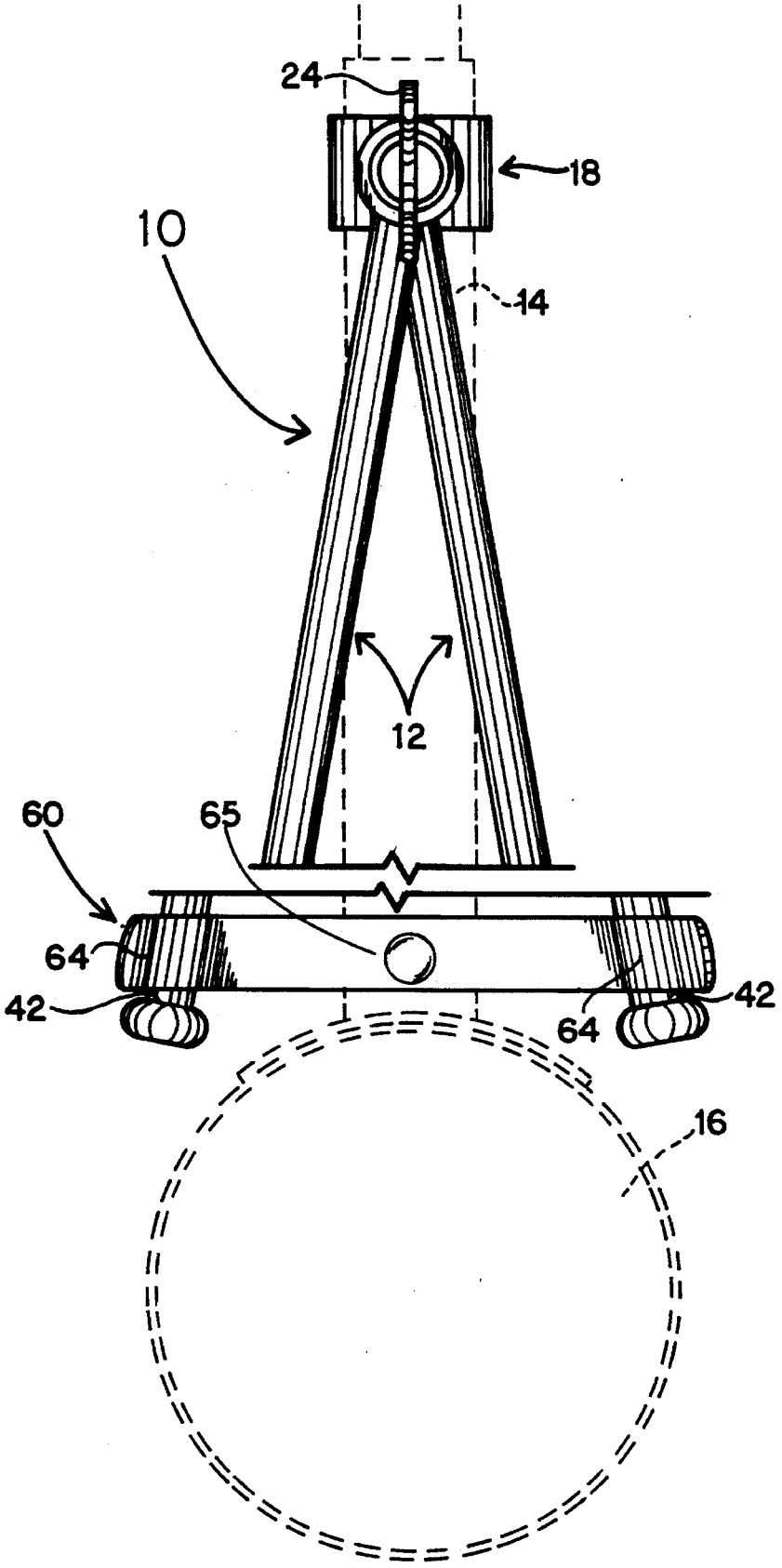
FIGS. 7 is a front view of another embodiment of the invention, including one embodiment of a retainer.
Figure 8A:
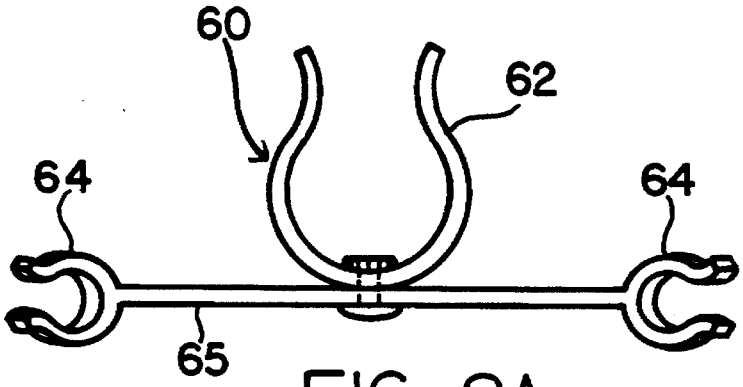
FIG. 8*a* is a top view of the retainer of FIG. 7.
Figure 8B:
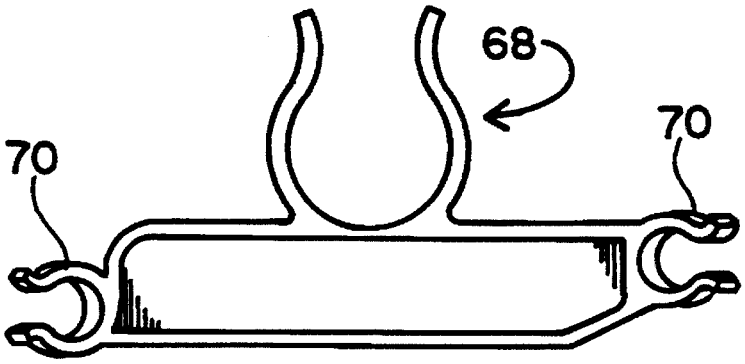
FIG. 8*b* is a top view of an alternative embodiment of a retainer, including offset leg clips.

Optionally, the stabilizer system may include a leg-retention means for holding the legs 12 in the downward, collapsed position close to the riser 14 to facilitate easy moving and storage of the irrigation lines without removing the stabilizer 10. The leg-retention means may be as simple as using a clamping means, such as was discussed above, to clamp the legs in the collapsed position. Alternatively, the leg-retention means may be a retainer 60 for snapping onto the riser 14 below where the stabilizer spring clip 18 is attached to the riser 14, as shown in FIGS. 7 and 8*a*. The retainer 60 has a retainer attachment means, which is a retainer spring clip 62, and two opposing leg clips 64 for receiving the foot ends 42 or center portions 44 of the legs. To use the retainer 60, the stabilizer 10 is manually slid longitudinally up the riser 14 or attached higher on the riser 14 than during normal use and then the two legs 12 are pivoted toward the riser 14 into a collapsed position and snapped into the leg clips 64.

The retainer 60 is adapted so that the leg clips 64 can receive the legs 12 even though the legs 12 pivot in two parallel but different planes. This adaptation may be done, for example, by designing the connector 65 to be resilient enough to bend slightly to receive the offset legs 12. Alternatively, the fastener 67 may be designed to let the connector 65 pivot to reach and receive the legs 12. Alternatively, a design such as the retainer 68 shown in FIG. 8*b* may be used. Retainer 68 features leg clips 70 that oppose each other but that also are offset from each other so that each leg clip 70 lies in the plane in which one of the legs 12 pivot.

The two legs 12 of the stabilizer 10 may be of various designs. For example, they may be made to telescope or otherwise retract to a more compact design when not in use. A cap or other foot 66 may be attached to the foot end 42 of each leg to prevent the leg from sinking into muddy ground or from collecting dirt. Primary considerations in choosing a foot design include the type of soil and crops, expense of construction, and whether the foot 66 would interfere with the pivoting together of the legs 12.

Preferably, the stabilizer system is made from lightweight, weather-resistant, and rust-resistant materials such as plastic or galvanized metal. For attachment means such as the stabilizer spring clip 18 or retainer spring clip 62, materials should be chosen that are resilient at a range of temperatures that allows installation and removal of the spring clip without damage during cooler weather.

While preferred embodiments of the invention have been shown and described, it will be apparent to those skilled in this art that various modifications may be made in these embodiments without departing from the spirit of the present invention. For that reason, the scope of the invention is set forth in the following claims:

We claim:

1. A stabilizer system for use with a portable irrigation line comprising a horizontal main pipe lying on the ground, a vertical riser upending from the main pipe and having a distal end, and a sprinkler head attached to the distal end of the riser, the stabilizer system comprising a stabilizer for attachment to the riser for holding the riser upright, the stabilizer comprising:

an attachment means adapted to receive and frictionally engage the vertical riser, a leg unit for extending to touch the ground, the leg unit comprising two legs pivotally connected to each other at a point of pivot, each leg having a center portion and an opposing top end and foot end, a connection means for connecting the leg unit at the point of pivot to the attachment means, so that each of the two legs of the leg unit pivots in a vertical plane and the two legs straddle the main pipe to touch the ground with their foot ends on opposite sides of the main pipe and a leg-retention means for releasably securing the two legs in a collapsed position wherein the legs extend generally vertically downward and are held close to the riser.

2. A stabilizer system as set forth in claim 1, wherein the leg-retention means comprises a retainer having a retainer attachment means for attachment to the riser and two leg clips connected to the retainer attachment means and extending horizontally outward in opposite directions, each leg clip for receiving one of the legs of the stabilizer.

3. A stabilizer system as set forth in claim 1, wherein the connection means pivotally connects the leg unit to the attachment means.

4. A stabilizer system as set forth in claim 1, wherein:

each of the two legs has a horizontal bore at the point of pivot and the connection means comprises a horizontal shaft and a lock means, the horizontal shaft being connected to the attachment means, extending horizontally from the attachment means and parallel to the main pipe, and extending through the horizontal bore of each of the two legs so that each leg pivots in a plane perpendicular to the horizontal shaft, and the lock means being for preventing each of the two legs from sliding off of the horizontal shaft.

5. A stabilizer system as set forth in claim 1, wherein each leg may pivot about 180 degrees to swing the foot end of each leg vertically up to be near the sprinkler head and to swing the foot end of each leg vertically down to be near the main pipe.

6. A stabilizer system as set forth in claim 1, wherein each leg may pivot about 360 degrees.

7. A stabilizer system for use with a portable irrigation line comprising a horizontal main pipe lying on the ground, a vertical riser upending from the main pipe and having a distal end, and a sprinkler head attached to the distal end of the riser, the stabilizer system comprising a stabilizer for attachment to the riser for holding the riser upright, the stabilizer comprising: a spring clip adapted for being securely and removably snapped onto and off of the vertical riser, the spring clip having two horizontal resilient arms for snapping around and frictionally engaging the riser, two legs, each having a top end and an opposing foot end, each leg being pivotally connected to the clip so that each leg pivots independently in a vertical plane, the two legs being for straddling the main pipe and extending to touch the ground with their said foot ends on opposite sides of the main pipe, and a leg-retention means for releasably securing the two legs in a collapsed position wherein the legs extend generally vertically downward and are held close to the riser.

8. A stabilizer system as set forth in claim 7, wherein the leg-retention means comprises a retainer having a retainer attachment means for attachment to the riser and two leg clips connected to the retainer attachment means and extending horizontally outward in opposite directions, each leg clip for receiving one of the legs of the stabilizer.

9. A stabilizer system as set forth in claim 7, wherein each leg may pivot about 180 degrees to swing the foot end of each leg vertically up to be near the sprinkler head and to swing the foot end of each leg vertically down to be near the main pipe.

10. A stabilizer as set forth in claim 7, wherein each leg may pivot 360 degrees.

11. A stabilizer for use with a portable irrigation line comprising a horizontal main pipe lying on the ground, a vertical riser upending from the main pipe and having a distal end, and a sprinkler head attached to the distal end of the riser, the stabilizer consisting of:

an attachment means adapted to receive and frictionally engage the vertical riser, a leg unit for extending to touch the ground, the leg unit consisting of two legs pivotally connected to each other at a point of pivot, each leg having a center portion and an opposing top end and foot end, and a connection means for connecting the leg unit at the point of pivot to the attachment means, so that each of the two legs of the leg unit pivots in a vertical plane and the two legs straddle the main pipe to touch the ground with their foot ends on opposite sides of the main pipe to hold the riser upright.

12. A stabilizer as set forth in claim 11, wherein the attachment means comprises a spring clip for being snapped onto and off of the riser, the said clip having two horizontal resilient arms for snapping around and frictionally engaging the riser.

13. A stabilizer as set forth in claim 11, wherein each leg may pivot about 180 degrees to swing the foot end of each leg vertically up to be near the sprinkler head and to swing the foot end of each vertically down to be near the main pipe.

14. A stabilizer as set forth in claim 11, wherein each leg may pivot about 360 degrees.

15. A stabilizer as set forth in claim 11, wherein:

each of the two legs has a horizontal bore at the point of pivot and the connection means comprises a horizontal shaft and a lock means, the horizontal shaft being connected to the attachment means, extending horizontally from the attachment means and parallel to the main pipe, and extending through the horizontal bore of each of the two legs so that each leg pivots in a plane perpendicular to the horizontal shaft, and the lock means being for preventing each of the two legs from sliding off of the horizontal shaft.

* * * * *